US007845407B2

(12) United States Patent
Bunnell et al.

(10) Patent No.: US 7,845,407 B2
(45) Date of Patent: Dec. 7, 2010

(54) PROFILE CONTROL APPARATUS AND METHOD FOR PRODUCTION AND INJECTION WELLS

(75) Inventors: Franz D. Bunnell, The Woodlands, TX (US); Manh V. Phi, Houston, TX (US)

(73) Assignee: ExxonMobil Upstream Research Co., Houston, TX (US)

( * ) Notice: Subject to any disclaimer, the term of this patent is extended or adjusted under 35 U.S.C. 154(b) by 192 days.

(21) Appl. No.: 12/085,210

(22) PCT Filed: Oct. 12, 2006

(86) PCT No.: PCT/US2006/039878

§ 371 (c)(1),
(2), (4) Date: May 19, 2008

(87) PCT Pub. No.: WO2007/078375

PCT Pub. Date: Jul. 12, 2007

(65) Prior Publication Data

US 2009/0183873 A1 Jul. 23, 2009

Related U.S. Application Data

(60) Provisional application No. 60/751,676, filed on Dec. 19, 2005.

(51) Int. Cl.
*E21B 43/08* (2006.01)

(52) U.S. Cl. ..... 166/278; 166/236

(58) Field of Classification Search ..... 166/278, 166/235, 236, 50, 105.1
See application file for complete search history.

(56) References Cited

U.S. PATENT DOCUMENTS 1,028,065 A 5/1912 Smith (Continued)

FOREIGN PATENT DOCUMENTS

WO WO 2004/094784 A2 11/2004
WO WO 2004/113671 A1 12/2004

OTHER PUBLICATIONS

C. Bennett et al. "Design Methodology for Selection of Horizontal Open-Hole Sand Control Completions Supported by Field Case Histories", SPE 65140, 2000 SPE European Petroleum Conference, Oct. 24-25, 2000, pp. 1-19, Paris, France.

(Continued)

*Primary Examiner*—Shane Bomar
*Assistant Examiner*—Blake Michener
(74) *Attorney, Agent, or Firm*—ExxonMobil Upstream Research Law Dept.

(57) ABSTRACT

Systems and associated methods for use in the production of hydrocarbons are described. The systems include a first tubular member and a second tubular member at least partially enclosing the first tubular member. Each of the first and second tubular members have a non-permeable longitudinal section and a permeable longitudinal section. The non-permeable longitudinal section of the second tubular member is disposed adjacent to the permeable longitudinal section of the first tubular member. Similarly, the permeable longitudinal section of the second tubular member is disposed adjacent to the non-permeable longitudinal section of the first tubular member. The permeable longitudinal section of the second tubular member is separated from the permeable longitudinal section of the first tubular member by a specific longitudinal distance.

41 Claims, 7 Drawing Sheets

U.S. PATENT DOCUMENTS

| | | | | |
|---|---|---|---|---|
| 1,604,386 | A | 10/1926 | Byerly | |
| 1,620,412 | A | 3/1927 | Tweeddale | |
| 4,064,938 | A | 12/1977 | Fast | |
| 5,355,949 | A | 10/1994 | Sparlin et al. | |
| 5,435,393 | A * | 7/1995 | Brekke et al. | 166/370 |
| 5,476,143 | A | 12/1995 | Sparlin et al. | |
| 5,642,781 | A | 7/1997 | Richard | |
| 5,722,490 | A | 3/1998 | Ebinger | |
| 5,782,299 | A | 7/1998 | Simone et al. | |
| 5,803,179 | A | 9/1998 | Echols et al. | |
| 5,881,809 | A | 3/1999 | Gillespie et al. | |
| 5,896,928 | A | 4/1999 | Coon | |
| 5,899,271 | A | 5/1999 | Simone et al. | |
| 5,909,774 | A | 6/1999 | Griffith et al. | |
| 6,125,932 | A | 10/2000 | Hamid et al. | |
| 6,220,345 | B1 | 4/2001 | Jones et al. | |
| 6,227,303 | B1 * | 5/2001 | Jones | 166/378 |
| 6,412,565 | B1 | 7/2002 | Castano-Mears | |
| 6,513,599 | B1 | 2/2003 | Bixenman et al. | |
| 6,581,689 | B2 | 6/2003 | Hailey, Jr. | |
| 6,601,646 | B2 | 8/2003 | Streich et al. | |
| 6,619,397 | B2 | 9/2003 | Coon et al. | |
| 6,622,794 | B2 | 9/2003 | Zisk, Jr. | |
| 6,659,179 | B2 | 12/2003 | Nguyen | |
| 6,695,054 | B2 | 2/2004 | Johnson et al. | |
| 6,745,843 | B2 | 6/2004 | Johnson et al. | |
| 6,752,206 | B2 | 6/2004 | Watson et al. | |
| 6,789,623 | B2 | 9/2004 | Hill, Jr. et al. | |
| 6,817,410 | B2 | 11/2004 | Wetzel et al. | |
| 6,830,104 | B2 | 12/2004 | Nguyen et al. | |
| 6,837,308 | B2 | 1/2005 | Michel | |
| 6,848,510 | B2 | 2/2005 | Bixenman et al. | |
| 6,857,475 | B2 | 2/2005 | Johnson | |
| 6,935,432 | B2 | 8/2005 | Nguyen | |
| 7,178,595 | B2 * | 2/2007 | Michel | 166/278 |
| 7,413,022 | B2 * | 8/2008 | Broome et al. | 166/386 |
| 7,464,752 | B2 * | 12/2008 | Dale et al. | 166/227 |
| 2002/0092649 | A1 | 7/2002 | Bixenman et al. | |
| 2004/0007829 | A1 | 1/2004 | Ross | |
| 2005/0087346 | A1 | 4/2005 | Bixenman et al. | |
| 2005/0263287 | A1 | 12/2005 | Achee, Jr. et al. | |
| 2007/0246212 | A1 * | 10/2007 | Richards | 166/227 |

OTHER PUBLICATIONS

T. M. V. Kaiser, et al., "Infow Analysis and Optimization of Slotted Liners", SPE 80145, 2000 SPE/Petroleum Society of CIM International Conference on Horizontal Well Technology, Nov. 6-8, 2000, pp. 200-209, Calgary, Alberta, Canada.

W. L. Penberthy and C. M. Shaughnessy, Chapter 4, "Gravel Pack Design", *Sand Control, SPE Series on Special Topics*, 1992, pp. 19-26, vol. 1, Henry L. Doherty Memorial Fund of AIME, Society of Petroleum Engineers, Richardson, TX.

R. S. Seright, et al, "A Strategy for Attacking Excess Water Production", SPC 84966, 2001 SPE Permian Basin Oil and Gas Recovery Conference, May 15-16, 2001, pp. 158-169, Midland, TX.

Y. Tang et al., "Performance of Horizontal Wells Completed with Slotted Liners and Perforations", SPE 65516, 2000 SPE/Petroleum Society of CIM International Conference on Horizontal Well Technology, Nov. 6-8, 2000, pp. 1-15, Calgary, Alberta, Canada.

D. L. Tiffin et al., "New Criteria for Gravel and Screen Selection for Sand Control", SPE 39437, 1998 SPE Formation Damage Control Conference, Feb. 18-19, 1998, pp. 201-214, Lafayette, LA.

G. K. Wong et al., "Design, Execution, and Evaluation of Frac and Pack (F&P) Treatments in Unconsolidated Sand Formations in the Gulf of Mexico", SPE 26563, 68$^{th}$ Annual SPE Technical Conference and Exhibition, Oct. 3-5, 1993, pp. 491-506, Houston, TX.

European Search Report No. 113433, dated May 24, 2006, 3 pages.

* cited by examiner

PROFILE CONTROL APPARATUS AND METHOD FOR PRODUCTION AND INJECTION WELLS

CROSS REFERENCE TO RELATED APPLICATIONS

This application is the National Stage of International Patent Application No. PCT/US06/39878, filed 12 Oct. 2006, which claims the benefit of U.S. Provisional Application No. 60/751,676, filed 19 Dec. 2005; the entire disclosures of each are incorporated herein by reference for all purposes.

FIELD OF THE INVENTION

This invention relates generally to an apparatus and method for use in wellbores. More particularly, this invention relates to a wellbore apparatus and method for producing hydrocarbons and managing sand production.

BACKGROUND

This section is intended to introduce the reader to various aspects of art, which may be associated with exemplary embodiments of the present invention, which are described and/or claimed below. This discussion is believed to be helpful in providing the reader with information to facilitate a better understanding of particular techniques of the present invention. Accordingly, it should be understood that these statements are to be read in this light, and not necessarily as admissions of prior art.

The production of hydrocarbons, such as oil and gas, has been performed for numerous years. To produce these hydrocarbons, a production system may utilize various devices, such as sand control devices and other tools, for specific tasks within a well. Typically, these devices are placed into a wellbore completed in either cased-hole or open-hole completion. In cased-hole completions, wellbore casing is placed in the wellbore and perforations are made through the casing into subterranean formations to provide a flow path for formation fluids, such as hydrocarbons, into the wellbore. Alternatively, in open-hole completions, a production string is positioned inside the wellbore without wellbore casing. The formation fluids flow through the annulus between the subsurface formation and the production string to enter the production string.

When producing fluids from subterranean formations, especially poorly consolidated formations or formations weakened by increasing downhole stress due to wellbore excavation and fluids withdrawal, it is possible to produce solid material (for example, sand) along with the formation fluids. In some cases, formations may produce hydrocarbons without sand until the onset of water production from the formations. With the onset of water, these formations collapse or fail due to increased drag forces (water generally has higher viscosity than oil or gas) and/or dissolution of material holding sand grains together.

The sand/solids and water production typically results in a number of problems. These problems include productivity loss, equipment damage, and/or increased treating, handling and disposal costs. For example, the sand/solids production may plug or restrict flow paths resulting in reduced productivity. The sand/solids production may also cause severe erosion damaging equipment, which may create well control problems. When produced to the surface, the sand is removed from the flow stream and has to be disposed of properly, which increases the operating costs of the well. Water production also reduces productivity. For instance, because water is heavier than hydrocarbon fluids, it takes more pressure to move it up and out of the well. That is, the more water produced, the less pressure available to move the hydrocarbons, such as oil. In addition, water is corrosive and may cause severe equipment damage if not properly treated. Similar to the sand, the water also has to be removed from the flow stream and disposed of properly.

The sand/solids and water production may be further compounded with wells that have a number of different completion intervals and the formation strength may vary from interval to interval. Because the evaluation of formation strength is complicated, the ability to predict the timing of the onset of sand and/or water is limited. In many situations reservoirs are commingled to minimize investment risk and maximize economic benefit. In particular, wells having different intervals and marginal reserves may be commingled to reduce economic risk. One of the risks in these applications is that sand failure and/or water breakthrough in any one of the intervals threatens the remaining reserves in the other intervals of the completion.

While typical sand control, remote control technologies and interventions may be utilized, these approaches often drive the cost for marginal reserves beyond the economic limit. As such, a simple, lower cost alternative may be beneficial to lower the economic threshold for marginal reserves and to improve the economic return for certain larger reserve applications. Accordingly, the need exists for a well completion apparatus that provides a mechanism for managing the production of sand and water within a wellbore, while being able to maintain dimensional limitations.

Other related material may be found in at least U.S. Pat. Nos. 5,722,490; 6,125,932; 4,064,938; 5,355,949; 5,896,928; 6,622,794; 6,619,397; and International Patent Application No. PCT/US2004/01599. Further, additional information may also be found in Penberthy & Shaughnessy, SPE Monograph Series—"Sand Control", ISBN 1-55563-041-3 (2002); Bennett et al., "Design Methodology for Selection of Horizontal Open-Hole Sand Control Completions Supported by Field Case Histories," SPE 65140 (2000); Tiffin et al., "New Criteria for Gravel and Screen Selection for Sand Control," SPE 39437 (1998); Wong G. K. et al., "Design, Execution, and Evaluation of Frac and Pack (F&P) Treatments in Unconsolidated Sand Formations in the Gulf of Mexico," SPE 26563 (1993); T. M. V. Kaiser et al., "Inflow Analysis and Optimization of Slotted Liners," SPE 80145 (2002); and Yula Tang et al., "Performance of Horizontal Wells Completed with Slotted Liners and Perforations," SPE 65516 (2000).

SUMMARY

In one embodiment, a system associated with the production of hydrocarbons is described. The system includes a first tubular member and a second tubular member at least partially enclosing the first tubular member disposed within a wellbore environment (e.g. a subsurface environment). The first tubular member has a non-permeable longitudinal section and a permeable longitudinal section, wherein the permeable longitudinal section has a first plurality of openings between a first central channel and a region external to the first tubular member. The second tubular member includes a non-permeable longitudinal section in substantial radial alignment with the permeable longitudinal section of the first tubular member and a permeable longitudinal section, wherein the permeable longitudinal section of the second tubular member is in substantial radial alignment with the non-permeable longitudinal section of the first tubular member and the permeable longitudinal section of the second tubular member is separated from the permeable longitudinal section of the first tubular member by a specific longitudinal distance. The specific longitudinal distance is calculated based on geometry, fluid, and sand properties of the wellbore environment. Also, the permeable longitudinal section of the second tubular member has a second plurality of openings between an internal region of the second tubular member and a region external to the second tubular member that allows particles having a particular size to pass therethrough. The system provides a flow path for hydrocarbons through the first tubular member.

In an alternative embodiment, a system associated with the production of hydrocarbons is described. The system includes a wellbore utilized to produce hydrocarbons from a subsurface reservoir, a production tubing string disposed within the wellbore, a perforated base pipe coupled to the production tubing string and disposed within the wellbore adjacent to the subsurface reservoir, and a tubular member at least partially enclosing the perforated base pipe. The perforated base pipe includes a non-permeable longitudinal section and a permeable longitudinal section, wherein the permeable longitudinal section has a plurality of slots between a central channel of the perforated base pipe and a region external to the perforated base pipe. The tubular member includes a non-permeable longitudinal section disposed adjacent to the permeable longitudinal section of the perforated base pipe and a permeable longitudinal section of the tubular member having a plurality of openings between an internal region of the tubular member and a region external to the tubular member that permits the passage of certain sized particles. Further, the permeable longitudinal section of the tubular member is disposed adjacent to the non-permeable longitudinal section of the perforated base pipe and the permeable longitudinal section of the tubular member is separated from the permeable longitudinal section of the perforated base pipe by a specific longitudinal distance, which is calculated based on geometry, fluid, and sand properties of the wellbore. The system further includes producing hydrocarbons from the perforated base pipe.

In another embodiment, a method associated with the production of hydrocarbons is described. The method includes measuring the geometry, fluid, and sand properties of a wellbore environment and calculating a specific longitudinal distance utilizing the measured properties. The method additionally includes providing a first tubular member, wherein the first tubular member comprises a non-permeable longitudinal section of the first tubular member and a permeable longitudinal section of the first tubular member that allows fluids to flow between a first central channel and a region external to the first tubular member; providing a second tubular member at least partially enclosing the first tubular member, wherein the second tubular member comprises a non-permeable longitudinal section of the second tubular member disposed adjacent to the permeable longitudinal section of the first tubular member and a permeable longitudinal section of the second tubular member that allows fluids and sand particles to flow between a second central channel and a region external to the second tubular member, and the permeable longitudinal section of the second tubular member; and disposing the non-permeable longitudinal section of the first tubular member adjacent to the permeable longitudinal section of the second tubular member, wherein the permeable longitudinal section of the first tubular member is separated from the permeable longitudinal section of the second tubular member by a specific longitudinal distance. Further, the method includes producing hydrocarbons from the first tubular member.

In an alternative embodiment, a system associated with the production of hydrocarbons is described. The system includes a first tubular member and a second tubular member at least partially enclosing the first tubular member. The first tubular member has a non-permeable longitudinal section and a permeable longitudinal section, wherein the permeable longitudinal section has a first plurality of openings between a first central channel and a region external to the first tubular member. The second tubular member includes a non-permeable longitudinal section in substantial radial alignment with the permeable longitudinal section of the first tubular member and a permeable longitudinal section, wherein the permeable longitudinal section of the second tubular member is in substantial radial alignment with the non-permeable longitudinal section of the first tubular member. Also, the permeable longitudinal section of the second tubular member has a second plurality of openings between an internal region of the second tubular member and a region external to the second tubular member that allows particles having a particular size to pass therethrough. Further, a plurality of axial partitions is disposed between the first and second tubular members to form a plurality of chambers therebetween. The system provides a flow path for hydrocarbons through the first tubular member.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, the specific embodiments of the present invention are described in connection with its preferred embodiments. However, to the extent that the following description is specific to a particular embodiment or a particular use of the present techniques, it is intended to be illustrative only and merely provides a concise description of the exemplary embodiments. Accordingly, the invention is not limited to the specific embodiments described below, but rather; the invention includes all alternatives, modifications, and equivalents falling within the true scope of the appended claims.

The present technique describes a sand control device and method that may be utilized in a production system to enhance production of hydrocarbons from a well and/or enhance the injection of fluids or gases into the well. Under the present technique, a sand control device is configured to utilize "tortuous paths" and to promote the formation of sand bridges to plug relatively long linear channels, passages or compartments within a sand control device. Accordingly, when sand is produced, the sand bridges form to plugs sections of a well to block the flow of sand and water into the well from sand producing intervals or zones of the formation. While plugging is generally considered a problem in other sand control approaches, the present techniques promote plugging in a controlled manner for water producing intervals of the well. In fact, the plugging feature of present techniques may be used to plug off sand producing intervals (with or without water) protecting hydrocarbon production for other intervals within the well. Thus, the present techniques utilize compartments in the body of the device or relatively large compartments within the production casing to create sand bridges when water is produced.

Figure 1:
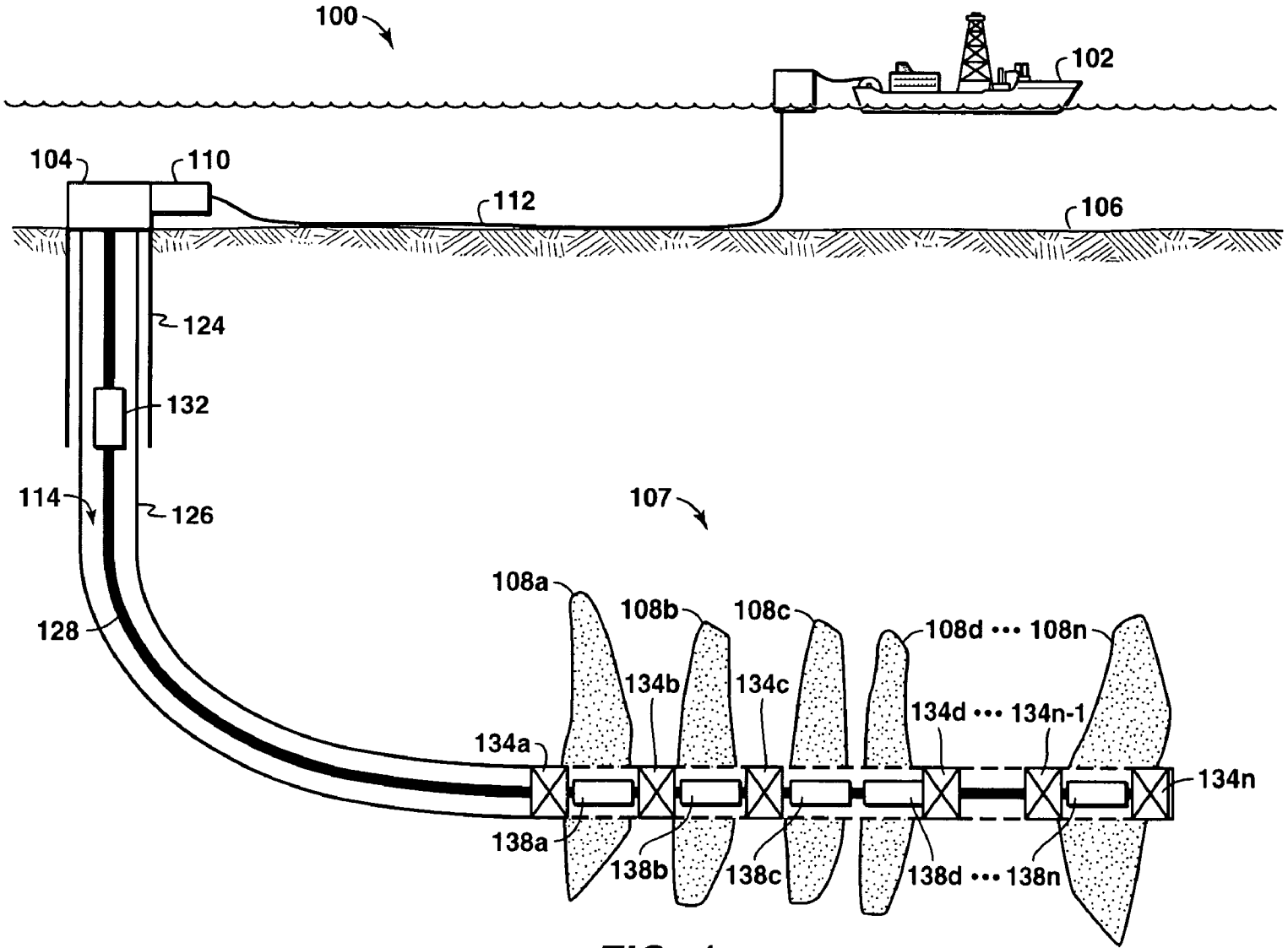
FIG. 1 is an exemplary production system in accordance with certain aspects of the present techniques.

Turning now to the drawings, and referring initially to FIG. 1, an exemplary production system 100 in accordance with certain aspects of the present techniques is illustrated. In the exemplary production system 100, a floating production facility 102 is coupled to a subsea tree 104 located on the sea floor 106. Through this subsea tree 104, the floating production facility 102 accesses one or more subsurface formations, such as subsurface formation 107, which may include multiple production intervals or zones 108*a*-108*n*, wherein number "n" is any integer number, having hydrocarbons, such as oil and gas. Beneficially, devices, such as sand control devices 138*a*-138*n*, may be utilized to enhance the production of hydrocarbons from the production intervals 108*a*-108*n*. However, it should be noted that the production system 100 is illustrated for exemplary purposes and the present techniques may be useful in the production or injection of fluids from any subsea, platform or land location.

The floating production facility 102 is configured to monitor and produce hydrocarbons from the production intervals 108*a*-108*n* of the subsurface formation 107. The floating production facility 102 may be a floating vessel capable of managing the production of fluids, such as hydrocarbons, from subsea wells. These fluids may be stored on the floating production facility 102 and/or provided to tankers (not shown). To access the production intervals 108*a*-108*n*, the floating production facility 102 is coupled to a subsea tree 104 and control valve 110 via a control umbilical 112. The control umbilical 112 may be operatively connected to production tubing for providing hydrocarbons from the subsea tree 104 to the floating production facility 102, control tubing for hydraulic or electrical devices, and a control cable for communicating with other devices within the wellbore 114.

To access the production intervals 108*a*-108*n*, the wellbore 114 penetrates the sea floor 106 to a depth that interfaces with the production interval 108*a*-108*n* at different intervals within the wellbore 114. As may be appreciated, the production intervals 108*a*-108*n*, which may be referred to as production intervals 108, may include various layers or intervals of rock that may or may not include hydrocarbons and may be referred to as zones. The subsea tree 104, which is positioned over the wellbore 114 at the sea floor 106, provides an interface between devices within the wellbore 114 and the floating production facility 102. Accordingly, the subsea tree 104 may be coupled to a production tubing string 128 to provide fluid flow paths and a control cable (not shown) to provide communication paths, which may interface with the control umbilical 112 at the subsea tree 104.

Within the wellbore 114, the production system 100 may also include different equipment to provide access to the production intervals 108*a*-108*n*. For instance, a surface casing string 124 may be installed from the sea floor 106 to a location at a specific depth beneath the sea floor 106. Within the surface casing string 124, an intermediate or production casing string 126, which may extend down to a depth near the production interval 108, may be utilized to provide support for walls of the wellbore 114. The surface and production casing strings 124 and 126 may be cemented into a fixed position within the wellbore 114 to further stabilize the wellbore 114. Within the surface and production casing strings 124 and 126, a production tubing string 128 may be utilized to provide a flow path through the wellbore 114 for hydrocarbons and other fluids. Along this flow path, a subsurface safety valve 132 may be utilized to block the flow of fluids from the production tubing string 128 in the event of rupture or break above the subsurface safety valve 132. Further, packers 134*a*-134*n* may be utilized to isolate specific zones within the wellbore annulus from each other. The packers 134*a*-134*n* may include external casing packers, such as the Swell-Packer™ (EZ Well Solutions) the MPas® Packer (Baker Oil Tools), or any other suitable packer for an open or cased hole well, as appropriate.

In addition to the above equipment, other devices or tools, such as sand control devices 138*a*-138*n*, may be utilized to manage the flow of particles into the production tubing string 128. The sand control devices 138*a*-138*n*, which may herein be referred to as sand control device(s) 138, may include slotted liners, stand-alone screens (SAS); pre-packed screens; wire-wrapped screens, membrane screens, expandable screens and/or wire-mesh screens. For exemplary purposes, the sand control devices 138 are herein described as being slotted basepipe with a perforated jacket, which is described further below in FIGS. 2A-2G. The sand control devices 138 may manage the flow of hydrocarbons from the production intervals 108 to the production tubing string 128.

As noted above, many wells have a number of completion intervals with the formation strength varying from interval to interval. Because the evaluation of formation strength is an uncertain science, the ability to predict the timing of the onset of sand and/or water is limited. Further, in many wells commingling of production intervals 108*a*-108*n* may be preferred to minimize investment risk and maximize economic benefit, which is particularly true for intervals with marginal reserves. A major risk in these applications is that sand failure and/or water breakthrough in any one interval threatens the remaining reserves in the well.

To address these concerns various sand and water control methods are commonly used. For instance, typical sand control methods include stand alone screens (also known as natural sand packs), gravel packs, frac packs and expandable screens. These methods limit sand production without increasing resistance to produced fluids, such as hydrocarbons. By themselves these sand control methods generally do not limit water production. Further, typical excess water control methods include cement squeezes, bridge plugs, straddle packer assemblies, and/or expandable tubulars and patches. In addition, some other wells may include chemical isolation methods, such as selective stimulation, relative permeability modifiers, gel treatments, and/or resin treatments. These methods are generally expensive, and utilize high risk interventions after the onset of water production.

Despite the variety of other methods utilized, available technology for controlling combined sand and water production is generally complex and expensive. Indeed, the high cost of conventional sand control, remote control technologies and intervention costs that are utilized to manage sand and water problems often drives cost for marginal projects beyond the economic limit for a given well or field. As such, a simple lower cost alternative is beneficial to lower the economic threshold for marginal reserves and to enhance the economic return for certain larger reserve applications. Accordingly, an exemplary sand control device 138 is shown in greater detail in FIGS. 2A-2G below.

FIGS. 2A-2G are exemplary embodiments of portions of a sand control device, such as one of the sand control devices 138*a*-138*n*, utilized in the production system 100 of FIG. 1 in accordance with certain aspects of the present techniques. Accordingly, FIGS. 2A-2G may be best understood by concurrently viewing FIG. 1. In FIGS. 2A-2G, the different exemplary embodiments of the components, such as a base pipe 202, axial rods 204*a*-204*h*, and an outer jacket 206, of the sand control device 138 are shown. These components are utilized to manage the flow of particles and water into the production tubing string 128.

Figure 2B:
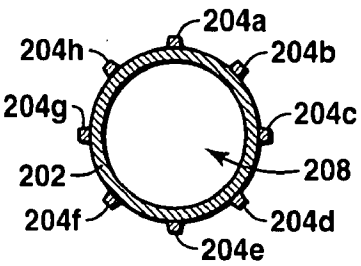
FIGS. 2A-2G are an exemplary embodiments of portions of a sand control device utilized in the production system of FIG. 1 in accordance with certain aspects of the present techniques.
Figure 2D:
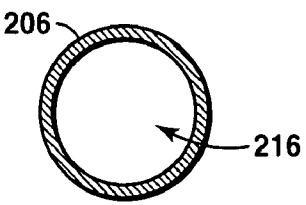
Figure 2A:
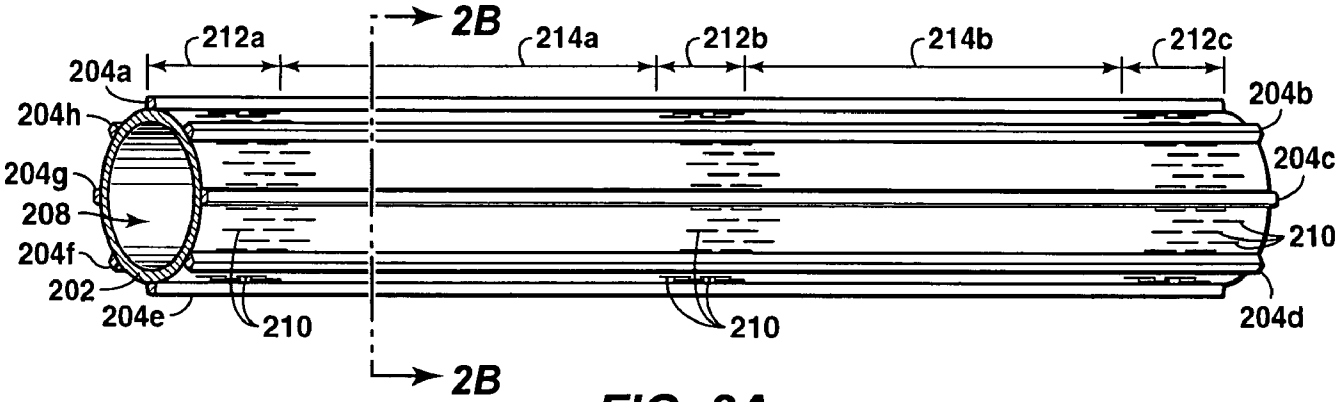

To begin, FIGS. 2A and 2B are an embodiment of the base pipe 202 and axial rods 204*a*-204*h*, which are coupled together. The base pipe 202, which may be referred to as an inner flow tube or a first tubular member, may be a section of pipe that has a central channel 208 and one or more openings, such as slots 210. The axial rods 204*a*-204*h*, which may be disposed longitudinal or substantially longitudinal along the base pipe 202, are coupled to the base pipe 202 via welds or other similar techniques. For instance, the rods 204*a*-204*h* may attach to the base pipe 202 via welds and/or be secured by end caps with welds. The base pipe 202 and the axial rods 204*a*-204*h* may include carbon steel or corrosion resistant alloy (CRA) depending on corrosion resistance intended for a specific application, which may be similar to selection of material for conventional screen applications. For an alternative perspective of the partial view of the base pipe 202 and axial rods 204*a*-204*h*, a cross sectional view of the various components along the line AA is shown in FIG. 2B.

To provide sand control, these slots 210 prevent or restrict the flow of particles, such as sand, from passing between the external region of the base pipe 202 and the central channel 208, as discussed below in greater detail. The slots 210 may be configured to prevent certain sized particles, such as sand, from passing between the central channel 208 and a region external to the base pipe 202. For instance, the slots 210 may be defined according to "Inflow Analysis and Optimization of Slotted Liners" and "Performance of Horizontal Wells Completed with Slotted Liners and Perforations." See T. M. V. Kaiser et al., "Inflow Analysis and Optimization of Slotted Liners," SPE 80145 (2002); and Yula Tang et al., "Performance of Horizontal Wells Completed with Slotted Liners and Perforations," SPE 65516 (2000). It should also be noted that the sand control layer on base pipe 206 may be wire wrapped screen and/or mesh type screens instead of slots in other embodiments.

Further, as part of this configuration, the slots 210 may be positioned in groups along different longitudinal sections or portions of the base pipe 202. That is, the sections of the base pipe having the slots 210 may be referred to as permeable longitudinal sections 212*a*-212*c*, while the closed or non-slotted sections of the base pipe 202 may be referred to as non-permeable longitudinal sections 214*a*-214*b*. The distribution of these sections 212*a*-212*c* and 214*a*-214*b* may be varied to provide different flow paths into the central opening or channel 208, which is discussed further below.

Figure 2C:
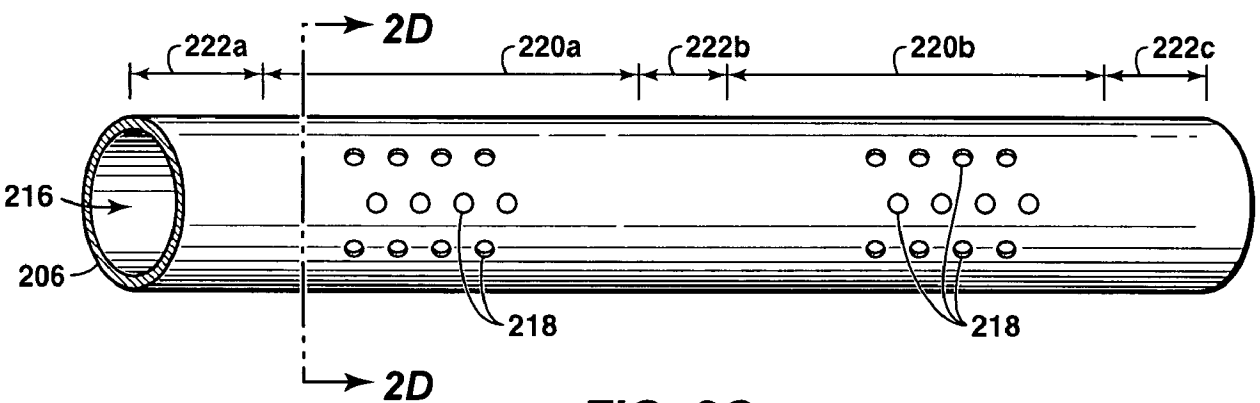

FIGS. 2C and 2D illustrate an outer jacket 206 disposed around the base pipe 202 and axial rods 204*a*-204*h*. The outer jacket 206, which may be referred to as an outer flow tube, second tubular member and/or jacket, may be a section of pipe with openings or perforations 218 along the length of the outer jacket 206. The perforations 218 may be sized to minimize flow restrictions (i.e. sized to allow particles, such as sand to pass through the perforations 218). The perforations may be shaped in the form of round holes, ovals, and/or slots, for example. The outer jacket 206 may include carbon steel or CRA, as discussed above. For an alternative perspective of the partial view of the outer jacket 206, a cross sectional view of the various components along the line BB is shown in FIG. 2D.

Similar to the base pipe 202, the perforations 218 may be positioned in groups along different portions of the outer jacket 206. That is, sections of the outer jacket 206 having the perforations 218 may be referred to as permeable longitudinal sections 220*a*-220*b*, while the non-perforated sections of the outer jacket 206 may be referred to as non-permeable longitudinal sections 222*a*-222*c*. The distribution of these sections 220*a*-220*b* and 222*a*-222*c* may be varied to provide different flow paths into the central opening 216, which is discussed further below.

Figure 2F:
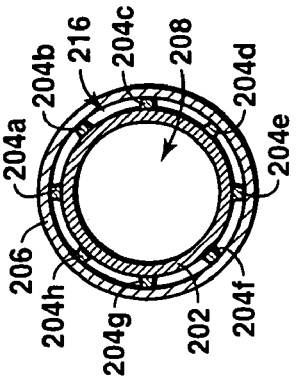
Figure 2E:
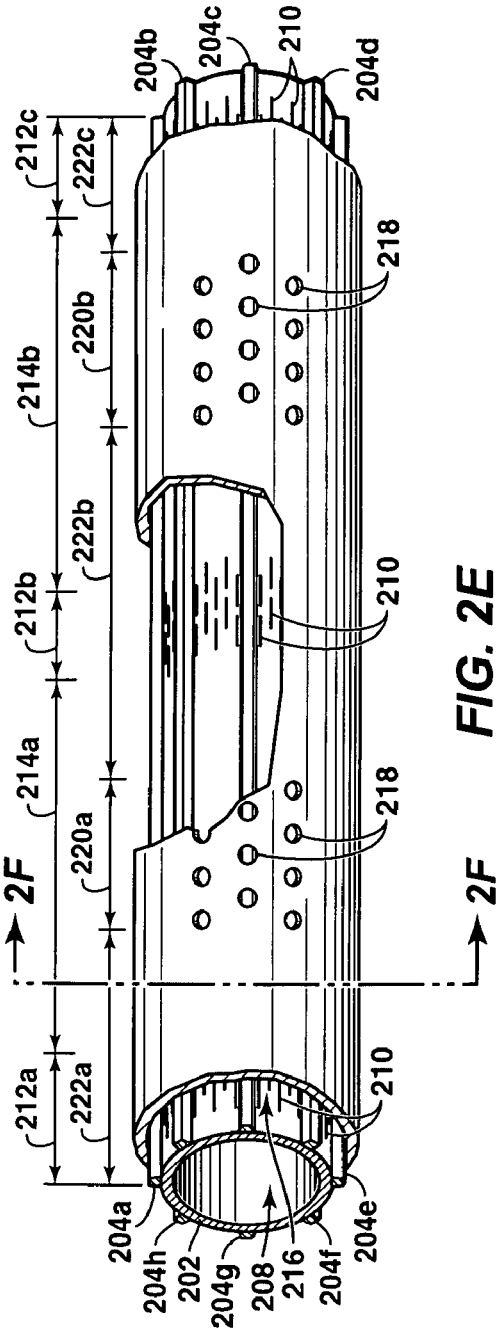

FIGS. 2E and 2F illustrate an embodiment with the outer jacket 206 disposed around the base pipe 202 and axial rods 204*a*-204*h*. The outer jacket 206 is secured to the base pipe 202 via the axial rods 204*a*-204*h*. This coupling may be made by welds or other similar techniques, as noted above. For instance, the outer jacket 206 may slide onto the base pipe 202 and axial rods 204*a*-204*h*, which are welded together. Then, ends of the outer jacket 206 may be secured to the base pipe 202 and axial rods 204*a*-204*h* by welds with end caps. Alternatively, the axial rods 204*a*-204*h* may be secured to the outer jacket 206 with welds and then slid onto the base pipe 202, which is again secured with end caps. For an alternative perspective of the partial view of the base pipe 202, axial rods 204*a*-204*h* and outer jacket 206, a cross sectional view of the various components along the line CC is shown in FIG. 2F.

As discussed above, the sections 220*a*-220*b* and 222*a*-222*c* of the outer jacket 206 may be longitudinally aligned with specific sections 212*a*-212*c* and 214*a*-214*b* of the base pipe 202. For instance, permeable longitudinal sections 220*a*-220*b* of the outer jacket 206 may be aligned with the non-permeable longitudinal sections 214*a*-214*b* of the base pipe 202. Similarly, the non-permeable longitudinal sections 222*a*-222*c* of the outer jacket 206 may be aligned with the permeable longitudinal sections 212*a*-212*c* of the base pipe 202. In this configuration, the perforations 218 in the outer jacket 206 and slots 210 in the base pipe 202 may be offset by a specific distance, which may be referred to as a specific longitudinal distance, to divert the radial flow path through the openings 216 to a linear flow path along the axis of the base pipe 202 between the axial rods 204*a*-204*h* to the slots 210. At the slots 210, the flow is again diverted to a radial flow path through the slots 210 into the central channel 208. The distance of the linear flow path between the perforations 218 and the slots 210 (i.e. the "specific longitudinal distance") is designed to provide the desired degree of plugging and isolation for the sand control device 138, which is discussed further below.

Figure 2G:
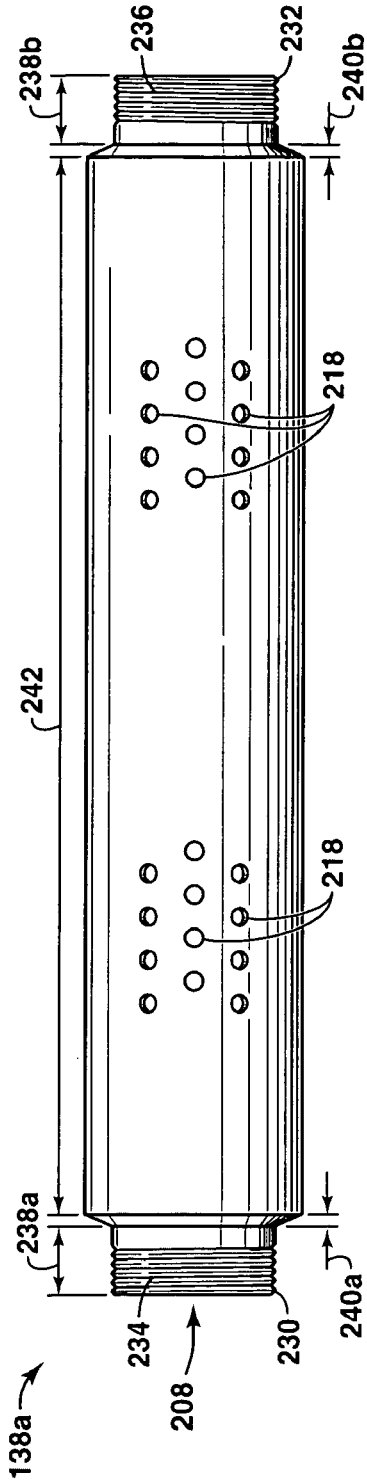

FIG. 2G illustrates an embodiment of the assembled sand control device 138*a* with the end caps 230-232 disposed around the base pipe 202, axial rods 204*a*-204*h* and outer jacket 206. Each of the end caps 230-232, which include neck sections 238*a*-238*b*, may include one set of threads 234-236 that are utilized to couple the sand control device 138*a* with other sand control devices, sections of pipe and/or other devices. The end caps 230-232 may be coupled to the outer jacket 206, axial rods 204*a*-204*h* and/or the base pipe 202 at neck regions 238*a*-238*b*, which include sections 240*a*-240*b*, respectively. In the neck regions 238*a*-238*b*, the end caps 230-232, outer jacket 206, axial rods 204*a*-204*h* and base pipe 202 may be welded in a manner similar to that performed on wire wrapped screens. The base pipe 202 may extend beyond either end of the outer jacket 206 to provide room for tubing connections, for connecting sections of sand control devices together, or for connecting other tools with the sand control device 138*a*.

Beneficially, by providing slots 210 and perforations 218 in specific sections of the base pipe 202 and outer jacket 206, the flow paths may be relatively long to ensure the channels formed between the base pipe 202, axial rods 204*a*-204*h* and outer jacket 206 plug when sand is produced from the production interval. Unlike other approaches that use tortuous flow path concepts to increase erosion resistance of primary sand control devices and to manage pressure drop across completions for balancing flow profiles, the present embodiment uses longer linear flow paths to plug the compartment, not short flow paths, which may not plug the sand control device to prevent or restrict the flow of fluids. Accordingly, the tortuous flow path created by the distance separating the slots 210 and perforations 218 are utilized to plug off flow and associated water production to protect the remaining intervals in the well. That is, the perforations 218 of the outer jacket 206 are simply utilized to divert flow, while the slots 210 are the sand control device that blocks sand. As such, the present embodiment utilized the tortuous flow path to provide a mechanism that creates sand bridges to plug the flow path into the slots 210.

In addition, the present embodiment provides an automated mechanism for managing a sand control device without user intervention, high cost, risky intervention or without relying on expensive sensors to determine the conditions within the wellbore. As noted above, other approaches utilize mechanical and chemical techniques that rely upon user intervention to re-enter the wellbore, to actuate pre-installed downhole devices, to install shut off devices (plugs, patches etc) and/or to pump some chemical to block off the unwanted water producing interval. These active devices are complex and expensive to implement. However, the present embodiment is a passive shut-off device. In fact, the base pipe 202, axial rods 204*a*-204*h* and outer jacket 206 in this embodiment do not even have moving parts. As such, the plugging of the interval of the wellbore adjacent to the sand control device is automatically performed without user intervention.

Figure 3A:
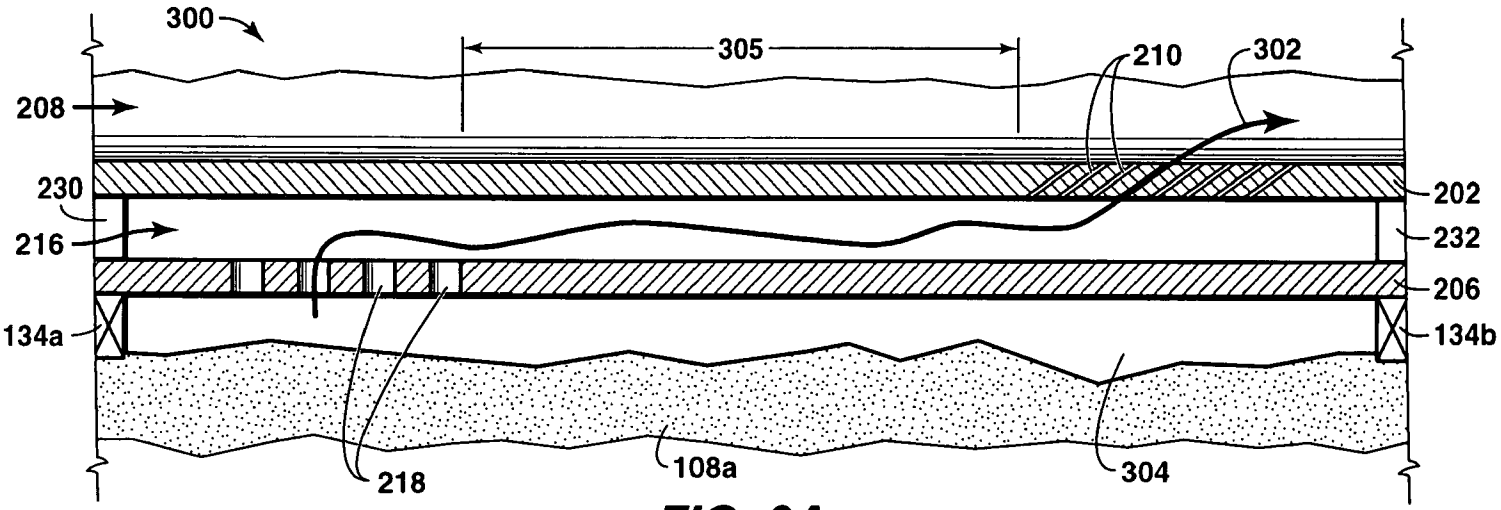
FIGS. 3A-3D are exemplary embodiments of a compartment of the sand control device within a wellbore of FIG. 1 in accordance with certain aspects of the present techniques.

As an example, FIGS. 3A-3D are exemplary embodiments of the present techniques in a single chamber or compartment 300 of the sand control device, which may be sand control device 138*a*, within the wellbore 114 of FIG. 1 in accordance with certain aspects of the present techniques. Accordingly, FIGS. 3A-3B may be best understood by concurrently viewing FIGS. 1, 2A-2G. In FIG. 3A, fluid flow is shown along the production flow path 302. As discussed above, a compartment is formed between the base pipe 202 and the outer jacket 206. By offsetting the perforations 218 from the slots 210 by a specific distance 305, which is the specific longitudinal distance, the production flow path 302 follows a radial path to pass through the perforations 218. Then, the production flow path 302 passes through the compartment along a relatively long, narrow path through the slots 210 of the base pipe 202 into the central channel 208 within the base pipe inner diameter (ID). From the slots 210, fluids pass into the central channel 208 and through the production tubing string 128 to the floating production facility 102.

Figure 3B:
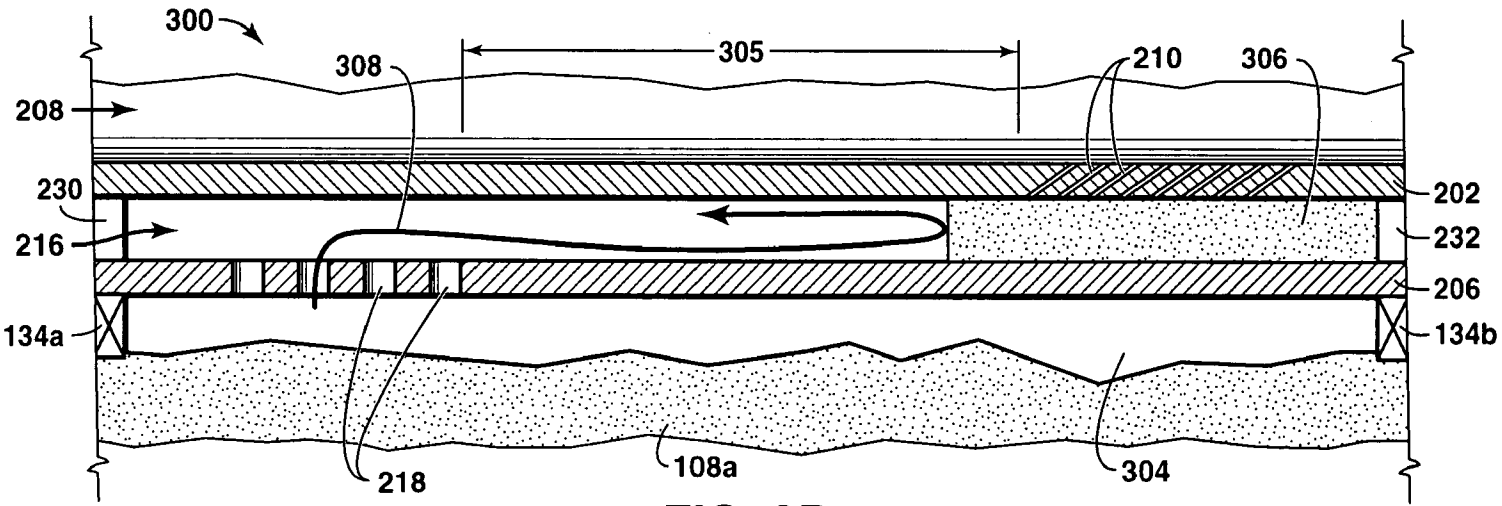

However, when sand is produced, a sand bridge 306 forms to block the fluid flow path 302 into the compartment 300, as shown in FIG. 3B. In FIG. 3B, the sand bridge 306 prevents fluids, such as water and hydrocarbons, and particles, such as sand, from passing into the central channel 208 formed by the base pipe ID. As a result, the flow path 302 is plugged within the compartment. This blocking flow path 302 continues to fill the compartment with particles until the compartment forms a complete or partial barrier to fluids and particles. In certain applications where water production destabilizes the formation and causes sand production, the sand bridge 306 created by the sand control device 138*a* may limit or prevent further sand and water production within the interval of the wellbore that the sand control device 138*a* is installed. Beneficially, this limits the impact of sand and water on the integrity of production from other intervals, wells and the facilities.

The distance 305 is calculated based on the geometry, fluid properties and sand properties of the well using common models for fluid flow in porous media. In particular, the distance 305 is calculated to achieve a target pressure drop at a given flow rate and provide sufficient resistance to fluid flow once the compartment is at least partially filled with sand. The calculation may be based on commonly used models/equations for fluid flow in porous media. Some of the specific parameters that may be utilized in determining the distance 305 may include the cross sectional flow area of the chamber, the permeability of the plugging material (i.e. the sand filling the chamber) and fluid properties (i.e. viscosity). These properties may be known values or may be theoretical properties derived from experience, experimentation, data from related well sites, and other sources.

Figure 3C:
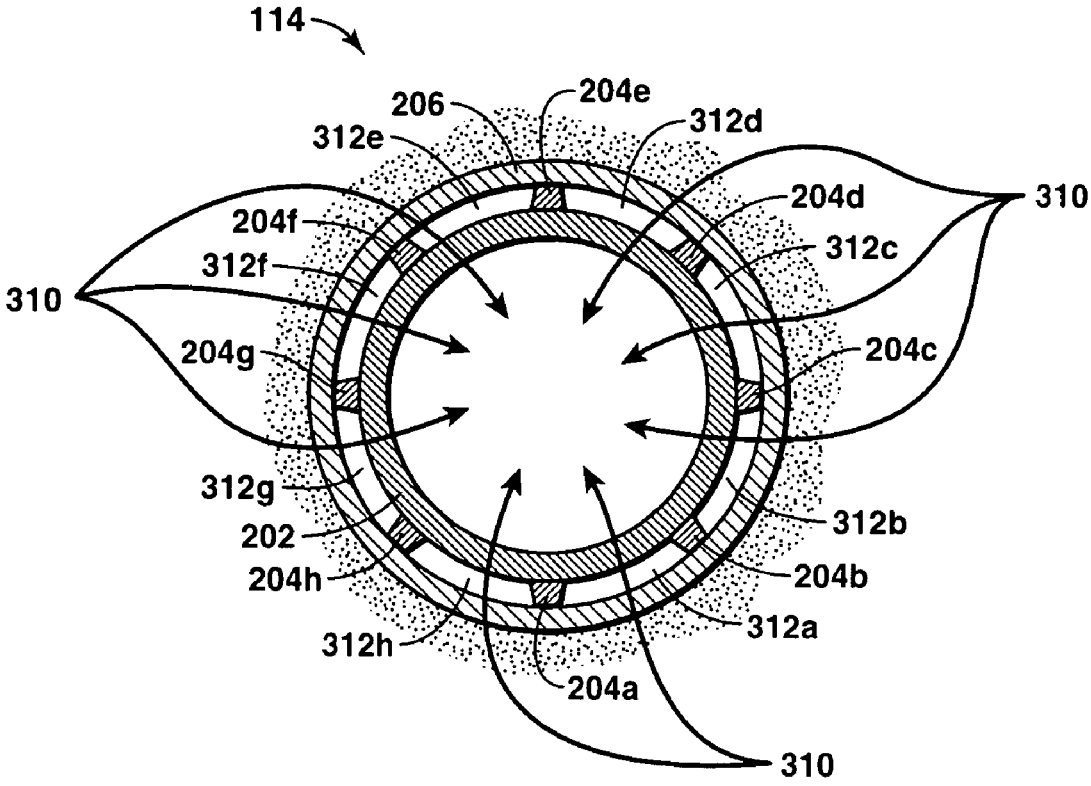
Figure 3D:
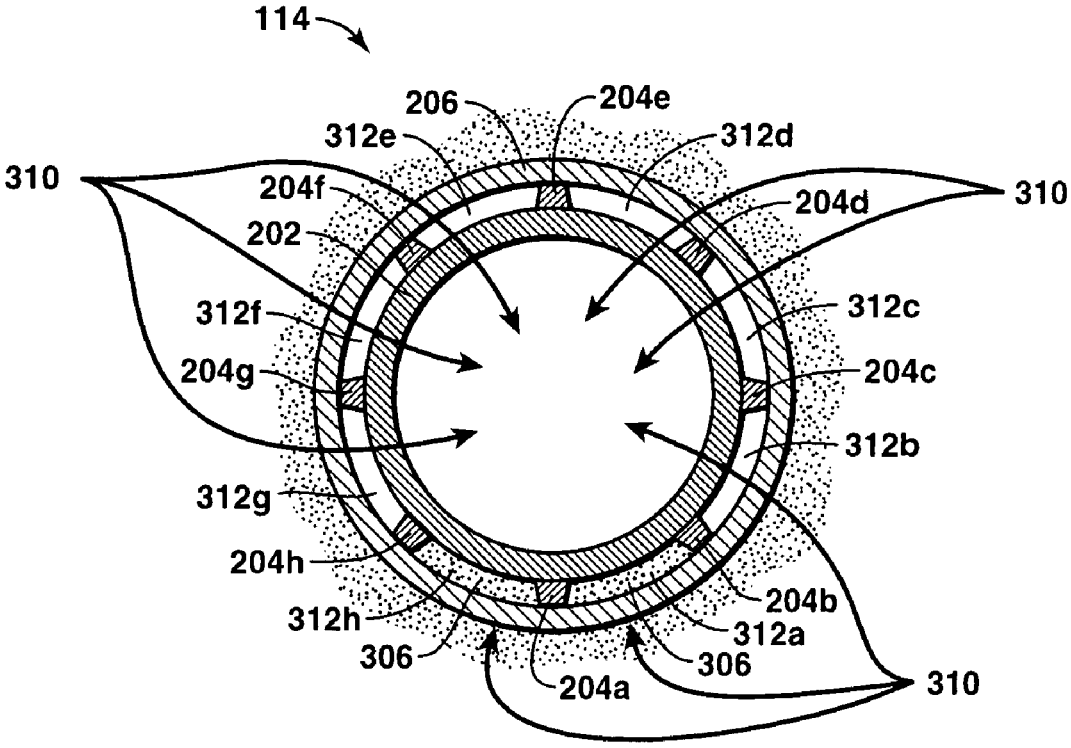

A further advantageous aspect of the present techniques is shown in FIGS. 3C-3D. FIG. 3C shows an axial view of one embodiment of a sand control device 138*a* in accordance with the present techniques disposed within a production interval 108*a*-108*n* of a wellbore 114. The flow from the production interval 310 may enter any one of a plurality of axial chambers 312*a*-312*h* formed by the basepipe 202, the outer jacket 206, and the plurality of axial rods 204*a*-204*h*. However, when sand is produced, a sand bridge 306 forms in at least one of the plurality of axial chambers 312*a*-312*h* to prevent fluids, such as water and hydrocarbons, and particles, such as sand, from passing into the central channel 208 formed by the base pipe ID. As a result, the flow path 310 is plugged within the at least one axial chamber while the remaining axial chambers remain open to fluid flow unless or until those axial chambers are filled with sand. Beneficially, this allows for finer control over the production of sand and water by blocking only those longitudinal and radial portions of the production interval in which sand and water are being produced, while allowing the flow of hydrocarbons in specific areas where sand and water production are not present. A skilled artisan will recognize that a different chamber configuration and a different number of chambers is within the scope of this embodiment.

Furthermore, sand control device may provide enhancements to a multi-zone reservoir or formation, such as subsurface formation 107. For example, a subsurface formation 107 may include multiple production zones or intervals 108*a*-108*n* that produce sand free for some period of time. These intervals may be isolated or commingled with other production intervals within the well. Typically, after a certain amount of depletion/drawdown or with the onset of water production from different production intervals, premature water breakthrough and/or sand failure may threaten the other production intervals of the well. However, with the present sand control devices, sand failure in a specific interval may plug off as the linear flow channels through and adjacent to the sand control device fill with sand and plug. As a result, any producing production intervals may continue to provide hydrocarbons, while the sand control devices 138*a*-138*n* may block the flow of sand and water from depleted production intervals 108*a*-108*n*. Accordingly, the use of the exemplary sand control devices with multiple production intervals within a well is shown in greater FIGS. 4-6 below.

Figure 4:
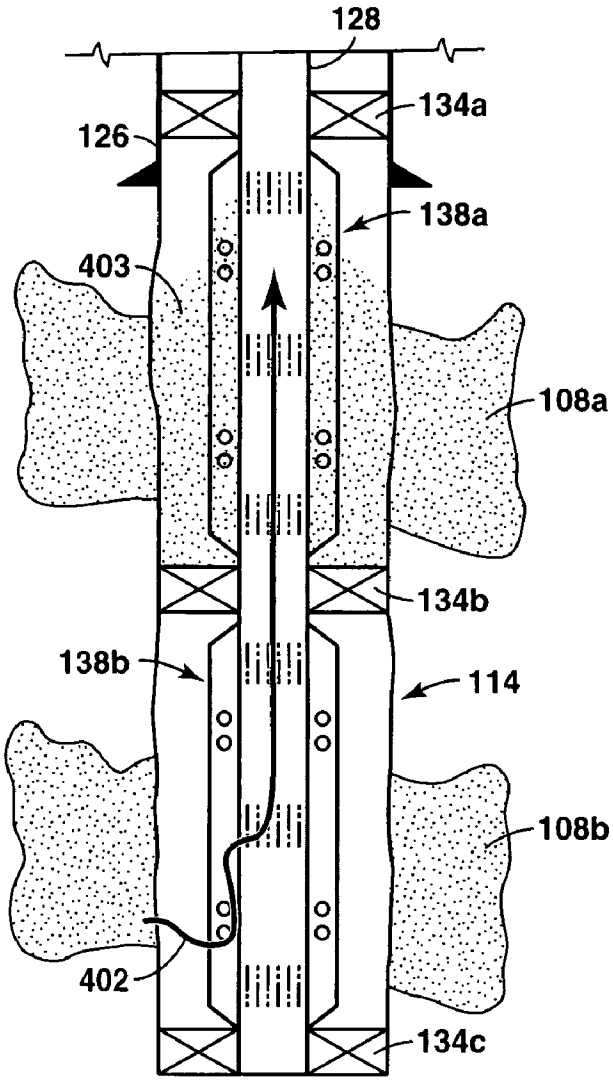
FIG. 4 is an exemplary embodiment of the sand control devices within an open hole multi-zone well in accordance with certain aspects of the present techniques.

FIG. 4 is an exemplary embodiment of the sand control devices 138*a*-138*n* within the wellbore 114 of FIG. 1 in accordance with certain aspects of the present techniques. Accordingly, FIG. 4 may be best understood by concurrently viewing FIGS. 1, 2A-2G and 3A-3B. In FIG. 4, which may be a preferred use of the sand control devices 138*a* and 138*b*, a section of the wellbore 114 is shown with sand control devices 138*a* and 138*b* disposed adjacent to production intervals 108*a* and 108*b*. In this section, packers 134*a*, 134*b* and 134*c* are utilized with the sand control devices 138*a* and 138*b* to provide separate compartments that each access one of the production intervals 108*a* and 108*b*. With the sand control devices 138*a* and 138*b* located across the respective production intervals 108*a* and 108*b*, fluid flow paths, such as fluid flow path 402, for example, may be formed to allow fluids to flow from the production intervals 108*a* and 108*b* into the production tubing string 128 for each of the compartments. The distance (length of compartment, distance from holes in outer jacket to slots in base pipe) is calculated based on the geometry, fluid properties and sand properties, as discussed above. If one zone, such as production interval 108*a*, begins to produce sand, the produced sand fills the compartments in the sand control devices 138*a*. Flow resistance through the sand control device 138*a* increases as the compartments fill with sand effectively restricting flow from the sand producing interval. In particular, the production of sand is shown in sand control device 138*a*, which forms a sand bridge 403 that blocks fluid flow from this interval 108*a*. However, the flow path 402 through the sand control device 138*b* may continue to produce fluids.

Figure 5:
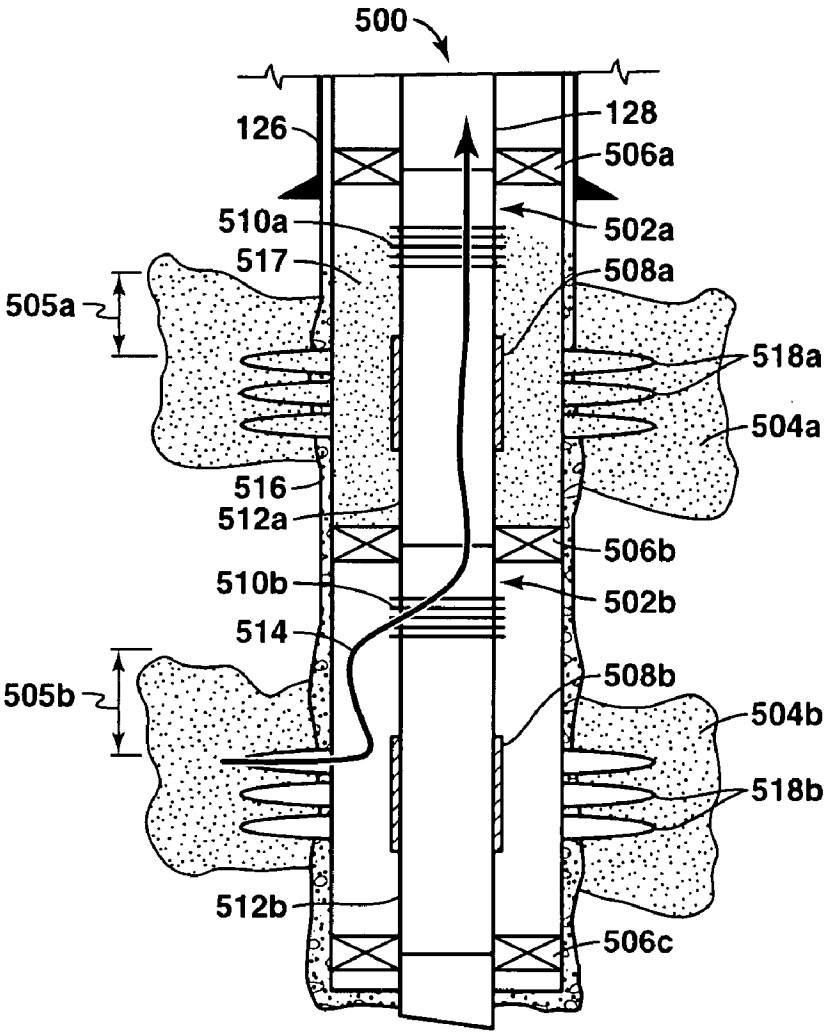
FIG. 5 is an exemplary embodiment of the sand control devices within a cased-hole multi-zone well in accordance with certain aspects of the present techniques.

FIG. 5 is an exemplary embodiment of the sand control devices 138*a*-138*n* disposed within a wellbore 500 for a cased-hole well in accordance with certain aspects of the present techniques. Accordingly, FIG. 5, which may utilize components discussed in FIGS. 1, 2A-2G and 3A-3B, may be best understood by concurrently viewing FIGS. 1, 2A-2G and 3A-3B. In the wellbore 500, perforations 518*a*-518*b* are created through the production casing string 126 and cement 516 to provide flow paths from production intervals 504*a*-504*b* of a subterranean formation, which may be similar to subterranean formation 107 of FIG. 1, to the production tubing string 128 via the sand control devices 502*a*-502*d*. These sand control devices 502*a*-502*b* may include various components that are configured to be located specific distances from or relative to the perforations 518*a*-518*b*. With the specific configuration, the flow paths created may limit or prevent sand and water production within the production intervals 504*a*-504*b* of the wellbore 500, as discussed above.

In FIG. 5, which may be a preferred use of the sand control devices 502*a*-502*b*, a section of the wellbore 500 is shown with sand control devices 502*a*-502*b* disposed adjacent to production intervals 504*a*-504*b*. In this section, packers 506*a*, 506*b* and 506*c*, which may be similar to packers 134*a*-134*n*, are utilized with the sand control devices 502*a*-502*b* to provide separate compartments that each access one of the production intervals 504*a*-504*b*. The sand control devices 502*a*-502*b* may include erosion resistant blast joints 508*a*-508*b* and sand screens 510*a*-510*b* disposed around basepipes 512*a*-512*b* that have openings (not shown) underneath the sand screens 510*a*-510*b*. The openings within the base pipes 512*a*-512*b* may be configured to allow fluids to flow into the basepipes 512*a*-512*b*, while particles of a specific size are blocked by the sand screens 510*a*-510*b*, as discussed above. The erosion resistant blast joints 508*a*-508*b* may be utilized to form perforations 518*a*-518*b* at a specific location relative to the sand screens 510*a*-510*b*.

Similar to the discussion above, the openings in the sand control devices 502*a*-502*b* may be located a sufficient distance 505*a*-505*b* across the respective production interval 504*a*-504*b*. However, in this configuration, the annulus between the production casing string 126 and the basepipes 512*a*-512*b* is utilized as the longer linear flow paths to plug the compartment of the annulus to prevent flow. For instance, fluid flow paths, such as fluid flow path 514, may be formed to allow fluids to flow from the production intervals 504*a*-504*b* into the production tubing string 128. As the fluid flows from the production intervals 504*a*-504*b* through the cement 516 and respective perforations 518*a*-518*b* into the production tubing string 128 for each of the compartments, a longitudinal distance 505*a*-505*b* separates the perforations 518*a*-518*b* from the sand screens 510*a*-510*b* to cause the fluid pressure to drop along the flow path 514. Accordingly, a sand bridge may form adjacent to the one of the sand control devices 502*a*-502*b* because of the pressure drop of fluid flowing through the perforations 518*a*-518*b* and the annulus between the sand control device 502*a*-502*b* and the production casing string 126. This sand bridge may effectively restrict the flow of fluids from the sand producing production interval. In particular, the formation of a sand bridge 517 adjacent to the sand control device 502*a* blocks fluid flow from the production interval 504*a* into the production tubing string 128. However, the flow of fluids from the production interval 504*b* may continue to produce fluids through the sand control device 502*b*.

Figure 6:
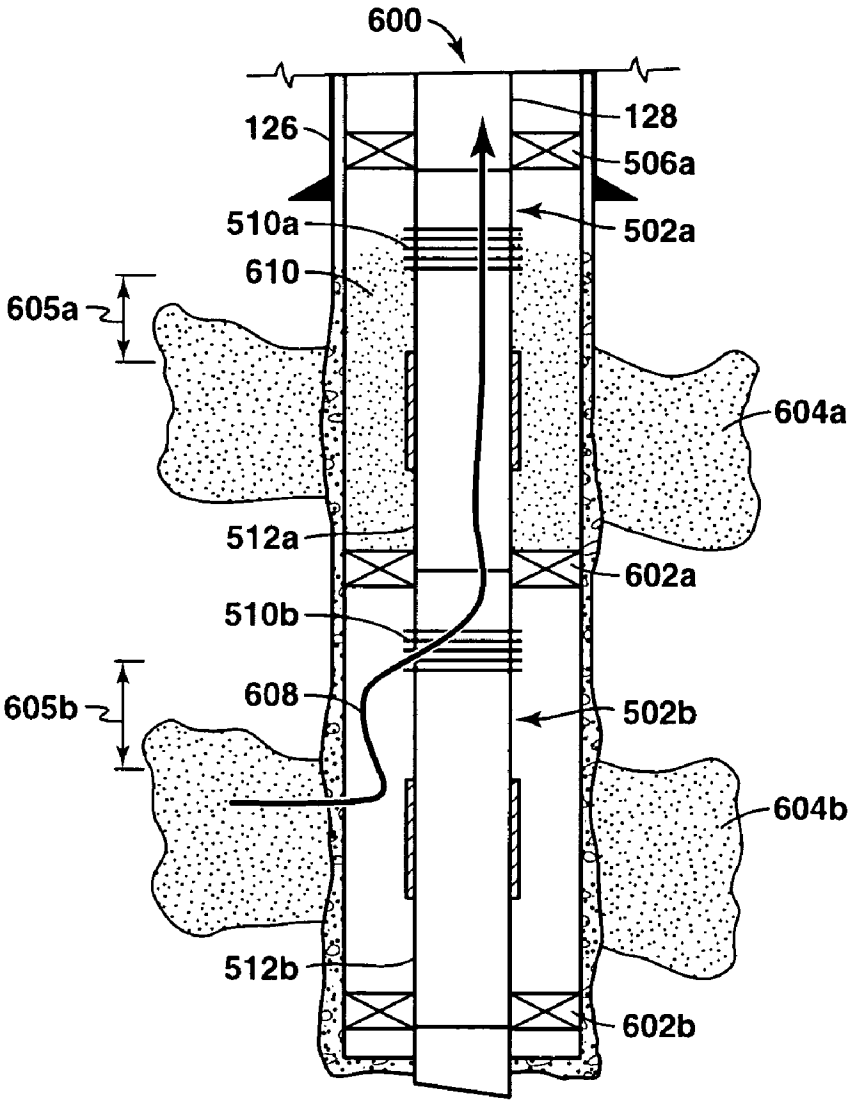
FIG. 6 is an exemplary embodiment of the sand control devices within an open-hole multi-zone well in accordance with certain aspects of the present techniques.

FIG. 6 is an exemplary embodiment of the sand control devices 138*a*-138*n* disposed within a wellbore 500 for an open-hole multi zone well in accordance with certain aspects of the present techniques. Accordingly, FIG. 6, which may utilize components discussed in FIGS. 1, 2A-2G and 3A-3B, may be best understood by concurrently viewing FIGS. 1, 2A-2G, 3A-3B and 5. In FIG. 6, flow paths from production intervals 604*a*-604*b* of a subterranean formation, which may be similar to subterranean formation 107 of FIG. 1, to the production tubing string 128 may be formed by disposing the sand control devices 502*a*-502*b* within the wellbore 600. These sand control devices 502*a*-502*b*, which are discussed above, may include various components that are configured to be located specific distances from or relative to the production intervals 604*a*-604*b*. With the specific configuration, the flow paths created may limit or prevent sand and water production within the production intervals 604*a*-604*b* of the wellbore 600, as discussed above.

Similar to the discussion above, the openings in the sand control devices 502*a* and 502*b* may be located a sufficient distance 605*a*-605*b* above the respective production interval 604*a*-604*b*. Open-hole packers 602*a*-602*b* may be disposed between production intervals 604*a*-604*b* to isolate different zones. However, in this configuration, the annulus formed between the walls of the wellbore 600 and the basepipes 512*a*-512*b* is utilized as the linear flow paths to plug the compartment of the annulus to prevent flow. For instance, fluid flow paths, such as fluid flow path 608, may be formed to allow fluids to flow from the production intervals 604*a*-604*b* into the production tubing string 128. As the fluid flows from the production intervals 604*a*-604*b* through the annulus into the production tubing string 128 for each of the compartments, a longitudinal distance 605*a*-605*b* separates the production intervals 604*a*-604*b* from the sand screens 510*a*-

510*b* to cause the fluid pressure to drop along the flow path 608. Accordingly, a sand bridge may form adjacent to the one of the sand control devices 502*a* and/or 502*b* because of the pressure drop of fluid flowing from the production intervals 604*a* and 604*b* in the annulus between the sand control device 502*a*-502*b* and walls of the wellbore 600. This sand bridge may effectively restrict the flow of fluids from the sand producing production interval. In particular, the formation of a sand bridge 610 adjacent to the sand control device 502*a* blocks fluid flow from the production interval 604*a* into the production tubing string 128. However, the flow of fluids from the production interval 604*b* may continue to produce fluids through the sand control device 502*b*.

Beneficially, the various combinations of these sand control devices 138*a*-138*n* and 502*a*-502*b* in FIGS. 4-6 may be utilized to control the production of sand and water for various production intervals or zones of a well. In fact, this control of sand and water production may be performed in a self-mitigating manner without user intervention (i.e. automatically). While one of the production intervals may be blocked by a sand bridge, other production intervals may continue to produce fluids unimpeded by sand and/or water production from the blocked production interval. Further, because this mechanism does not have any moving parts or components, it provides a low cost mechanism to exclude sand and shut off water production for certain oil field applications. Accordingly, the different configurations provide sand and water control with a long tortuous path formed by the outer jacket and base pipe.

The present techniques also encompass the placement of a tubular member over a previously disposed basepipe. For example, some wells may already have a perforated basepipe disposed in them to allow production fluid coming into the well, but lack a concentric pipe or tubular member to plug off unwanted fluid coming into the wellbore. These wells may not have produced sand and water at the time the basepipe was originally placed, but have begun to produce sand and water or are likely to begin producing such byproducts. In a case such as this, an operator may position a perforated tubular member inside the original basepipe at certain intervals determined to inhibit the production of sand and water through the basepipe. The size and placement of the openings along the pipe's length could be calculated based on measured properties of the wellbore environment.

It should be noted that any number of compartments may be formed within production intervals. For instance, as shown in FIGS. 4-6, one or more sand control devices may be utilized together to form a single compartment that includes multiple production intervals. In addition, one or more of the sand control devices may also be utilized with a single production interval. In this configuration, the different sand control devices may provide different zones or sections of control for a single production interval.

Further, as another variation on the embodiments described above, it should be appreciated that the sand screens 510*a*-510*b* in FIGS. 5 and 6 may be positioned or disposed below the respective producing interval 504*a*-504*b* and 604*a*-604*b*. This adjustment to the location of the sand screens 510*a*-510*b* in FIGS. 5 and 6 may provide benefits for certain applications and function in the same manner as described above. Also, sand screens 510*a*-510*b* may also be positioned above and below the producing intervals 504*a*-504*b* and 604*a*-604*b*. This configuration may be beneficial in high rate production applications. As such, different configurations may be utilized with the described embodiments to provide this functionality a production system.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A system associated with the production of hydrocarbons comprising:

a first tubular member disposed within a wellbore environment and defining a first central channel, the first tubular member comprising:

a non-permeable longitudinal section of the first tubular member; and a permeable longitudinal section of the first tubular member, wherein the permeable longitudinal section comprises a first plurality of openings between the first central channel of the first tubular member and a region external to the permeable longitudinal section; and a second tubular member at least partially enclosing the first tubular member, the second tubular member comprising:

a non-permeable longitudinal section of the second tubular member in substantial radial alignment with the permeable longitudinal section of the first tubular member; and a permeable longitudinal section of the second tubular member having a second plurality of openings between an internal region of the second tubular member and a region external to the second tubular member that permits particles less than a particular size to pass, wherein the permeable longitudinal section of the second tubular member is in substantial radial alignment with the non-permeable longitudinal section of the first tubular member, and wherein the permeable longitudinal section of the second tubular member is separated from the permeable longitudinal section of the first tubular member by a specific longitudinal distance calculated to form a sand bridge adjacent to the permeable longitudinal section of the first tubular member, wherein the specific longitudinal distance is calculated based on properties associated with the wellbore environment.

2. The system of claim 1 wherein the specific longitudinal distance is based on a calculated pressure drop for fluids flowing through the permeable longitudinal section of the second tubular member to the permeable longitudinal section of the first tubular member.

3. The system of claim 1 wherein the first tubular member comprises a perforated base pipe and the first plurality of openings are slots formed within the perforated base pipe that are configured to prevent sand particles from entering the first central opening.

4. The system of claim 3 wherein the second tubular member is a production casing string and the second plurality of openings is perforations in the production casing string.

5. The system of claim 3 wherein the second tubular member comprises a perforated outer jacket and the second plurality of openings are formed within the perforated outer jacket and configured to allow sand particles to enter a passage between the perforated outer jacket and the perforated base pipe.

6. The system of claim 5 comprising a plurality of axial rods disposed between the perforated outer jacket and the perforated base pipe.

7. The system of claim 5 wherein the perforated outer jacket and the perforated base pipe are coupled together as a wellbore tool.

8. The system of claim 5 comprising end caps secured to the perforated outer jacket and the perforated base pipe.

9. The system of claim 1 wherein the first tubular member is configured to provide produced hydrocarbons.

10. The system of claim 1 wherein the specific longitudinal distance is calculated to achieve a target pressure drop at a given flow rate.

11. The system of claim 1 wherein the specific longitudinal distance is calculated to form a sand bridge of sufficient size to block the flow of water into the first tubular member.

12. The system of claim 1 wherein the properties of the wellbore environment comprise geometry of the wellbore, fluid content within the wellbore, and sand content of the wellbore.

13. A system associated with production of hydrocarbons comprising:

a wellbore utilized to produce hydrocarbons from a subsurface reservoir;

a production tubing string disposed within the wellbore;

a perforated base pipe coupled to the production tubing string and disposed within the wellbore adjacent to subsurface reservoir, the perforated base pipe defining a central channel and comprising:

a non-permeable longitudinal section of the perforated base pipe; and a permeable longitudinal section of the perforated base pipe, wherein the permeable longitudinal section comprises a plurality of slots between the central channel of the perforated base pipe and a region external to the permeable longitudinal section; and a tubular member at least partially enclosing the perforated base pipe, the tubular member comprising:

a non-permeable longitudinal section of the tubular member disposed adjacent to the permeable longitudinal section of the perforated base pipe; and a permeable longitudinal section of the tubular member having a plurality of openings between an internal region of the tubular member and a region external to the tubular member that allows particles less than a particular size to pass, wherein the permeable longitudinal section of the tubular member is disposed adjacent to the non-permeable longitudinal section of the perforated base pipe, and wherein the permeable longitudinal section of the tubular member is separated from the permeable longitudinal section of the perforated base pipe by a specific longitudinal distance calculated to form a sand bridge adjacent to the permeable longitudinal section of the perforated base pipe, wherein the specific longitudinal distance is calculated based on properties associated with the wellbore.

14. The system of claim 13 wherein the properties of the wellbore comprise the geometry of the wellbore, fluid content within the wellbore, and sand content of the wellbore.

15. The system of claim 13 wherein the specific longitudinal distance is based on a calculated pressure drop for fluids flowing through the permeable longitudinal section of the tubular member to the permeable longitudinal section of the perforated base pipe.

16. The system of claim 15 wherein the specific longitudinal distance is calculated to form a sand bridge of sufficient size to block the flow of water into the perforated base pipe.

17. The system of claim 13 wherein the plurality of slots are configured to prevent sand particles from entering the central opening of the perforated base pipe.

18. The system of claim 17 wherein the tubular member is a production casing string disposed within the wellbore and enclosing the perforated base pipe and the plurality of openings is perforations in the production casing string.

19. The system of claim 17 wherein the tubular member comprises a perforated outer jacket and the plurality of openings are formed within the perforated outer jacket and configured to allow sand particles to enter a passage between the perforated outer jacket and the perforated base pipe.

20. The system of claim 19 comprising a plurality of axial rods disposed between the perforated outer jacket and the perforated base pipe.

21. The system of claim 19 wherein the perforated outer jacket and the perforated base pipe are welded together as a wellbore tool.

22. The system of claim 13 wherein the perforated base pipe is configured to produce hydrocarbons through the production tubing string.

23. The system of claim 13 wherein the specific longitudinal distance is calculated to achieve a target pressure drop at a given flow rate.

24. The system of claim 23 wherein the specific longitudinal distance is calculated based on at least one of chamber flow area, permeability of the plugging material and fluid properties.

25. A method associated with production of hydrocarbons comprising:

calculating a specific longitudinal distance based on properties associated with a wellbore environment;

providing a first tubular member, wherein the first tubular member comprises a non-permeable longitudinal section of the first tubular member and a permeable longitudinal section of the first tubular member that allows fluids to flow between a first central channel and a region external to the first tubular member;

providing a second tubular member at least partially enclosing the first tubular member, wherein the second tubular member comprises a non-permeable longitudinal section of the second tubular member disposed adjacent to the permeable longitudinal section of the first tubular member and a permeable longitudinal section of the second tubular member that allows fluids and sand particles to flow between a second central channel and a region external to the second tubular member, and the permeable longitudinal section of the second tubular member; and disposing the non-permeable longitudinal section of the first tubular member adjacent to the permeable longitudinal section of the second tubular member, wherein permeable longitudinal section of the first tubular member permeable is separated from the permeable longitudinal section of the second tubular member by the specific longitudinal distance to promote the formation of a sand bridge adjacent to the permeable longitudinal section of the first tubular member.

26. The method of claim 25 comprising disposing the first tubular member and the second tubular member within a wellbore.

27. The method of claim 26 comprising producing hydrocarbons from a subsurface formation via the first tubular member and the second tubular member.

28. The method of claim 26 comprising injecting fluids into the wellbore via the first tubular member and the second tubular member.

29. The method of claim 25 comprising forming a sand bridge adjacent to the permeable longitudinal section of the first tubular member.

30. The method of claim 25, wherein the properties associated with the wellbore environment comprise geometry of a wellbore, fluid content within a wellbore, and sand content of the wellbore environment.

31. A method of producing hydrocarbons, the method comprising:

disposing a production system in a wellbore, wherein the system comprises:

a first tubular member disposed within a wellbore environment and defining a first central channel, the first tubular member comprising:

a non-permeable longitudinal section of the first tubular member; and a permeable longitudinal section of the first tubular member, wherein the permeable longitudinal section comprises a first plurality of openings between the first central channel of the first tubular member and a region external to the permeable longitudinal section; and a second tubular member at least partially enclosing the first tubular member, the second tubular member comprising:

a non-permeable longitudinal section of the second tubular member in substantial radial alignment with the permeable longitudinal section of the first tubular member; and a permeable longitudinal section of the second tubular member having a second plurality of openings between an internal region of the second tubular member and a region external to the second tubular member that permits particles less than a particular size to pass, wherein the permeable longitudinal section of the second tubular member is in substantial radial alignment with the non-permeable longitudinal section of the first tubular member, and wherein the permeable longitudinal section of the second tubular member is separated from the permeable longitudinal section of the first tubular member by a specific longitudinal distance adapted to form a sand bridge adjacent to the permeable longitudinal section of the first tubular member, wherein the specific longitudinal distance is calculated based on properties associated with the wellbore environment; and producing hydrocarbons using the production system.

32. A method of producing hydrocarbons, the method comprising:

disposing a production tubing string in a wellbore utilized to produce hydrocarbons from a subsurface reservoir;

coupling a perforated base pipe to the production tubing string disposing the perforated base pipe within the wellbore adjacent to subsurface reservoir, the perforated base pipe defining a central channel and comprising:

a non-permeable longitudinal section of the perforated base pipe; and a permeable longitudinal section of the perforated base pipe, wherein the permeable longitudinal section comprises a plurality of slots between the central channel of the perforated base pipe and a region external to the permeable longitudinal section; and disposing a tubular member in the wellbore at least partially enclosing the perforated base pipe, the tubular member comprising:

a non-permeable longitudinal section of the tubular member disposed adjacent to the permeable longitudinal section of the perforated base pipe; and a permeable longitudinal section of the tubular member having a plurality of openings between an internal region of the tubular member and a region external to the tubular member that allows particles less than a particular size to pass, wherein the permeable longitudinal section of the tubular member is disposed adjacent to the non-permeable longitudinal section of the perforated base pipe, and wherein the permeable longitudinal section of the tubular member is separated from the permeable longitudinal section of the perforated base pipe by a specific longitudinal distance calculated to form a sand bridge adjacent to the permeable longitudinal section of the perforated base pipe, wherein the specific longitudinal distance is calculated based on properties associated with the wellbore; and producing hydrocarbons using the production tubing string.

33. A system associated with the production of hydrocarbons comprising:

a first tubular member disposed within a wellbore environment and defining a first central channel, the first tubular member comprising:

a non-permeable longitudinal section of the first tubular member;

a permeable longitudinal section of the first tubular member, wherein the permeable longitudinal section comprises a first plurality of openings between the first central channel of the first tubular member and a region external to the permeable longitudinal section; and a second tubular member at least partially enclosing the first tubular member, the second tubular member comprising:

a non-permeable longitudinal section of the second tubular member in substantial radial alignment with the permeable longitudinal section of the first tubular member; and a permeable longitudinal section of the second tubular member having a second plurality of openings between an internal region of the second tubular member and a region external to the second tubular member that allows particles less than a particular size to pass, wherein the permeable longitudinal section of the second tubular member is in substantial radial alignment with the non-permeable longitudinal section of the first tubular member, wherein the permeable longitudinal section of the second tubular member is separated from the permeable longitudinal section of the first tubular member by a specific longitudinal distance calculated to form a sand bridge adjacent to the permeable longitudinal section of the first tubular member, and wherein a plurality of axial partitions are disposed between the first and second tubular members to form a plurality of axial chambers.

34. The system of claim 33 wherein the first tubular member comprises a perforated base pipe and the first plurality of openings are slots formed within the perforated base pipe that are configured to prevent sand particles from entering the first central channel.

35. The system of claim 34 wherein the second tubular member is a production casing string and the second plurality of openings is perforations in the production casing string.

36. The system of claim 34 wherein the second tubular member comprises a perforated outer jacket and the second plurality of openings are formed within the perforated outer jacket and configured to allow sand particles to enter a passage between the perforated outer jacket and the perforated base pipe.

37. The system of claim 36 wherein the perforated outer jacket and the perforated base pipe are coupled together as a wellbore tool.

38. The system of claim 36 comprising end caps secured to the perforated outer jacket and the perforated base pipe.

39. The system of claim 33 wherein the first tubular member is configured to provide a flow path for produced hydrocarbons.

40. The system of claim 33 wherein there are eight axial chambers.

41. A method of producing hydrocarbons, the method comprising:

disposing a production system within a wellbore, wherein the production system comprises:

a first tubular member disposed within a wellbore environment and defining a first central channel, the first tubular member comprising:

a non-permeable longitudinal section of the first tubular member;

a permeable longitudinal section of the first tubular member, wherein the permeable longitudinal section comprises having a first plurality of openings between the first central channel of the first tubular member and a region external to the permeable longitudinal section; and a second tubular member at least partially enclosing the first tubular member, the second tubular member comprising:

a non-permeable longitudinal section of the second tubular member in substantial radial alignment with the permeable longitudinal section of the first tubular member; and a permeable longitudinal section of the second tubular member having a second plurality of openings between an internal region of the second tubular member and a region external to the second tubular member that allows particles less than a particular size to pass, wherein the permeable longitudinal section of the second tubular member is in substantial radial alignment with the non-permeable longitudinal section of the first tubular member, wherein the permeable longitudinal section of the second tubular member is separated from the permeable longitudinal section of the first tubular member by a specific longitudinal distance adapted to form a sand bridge adjacent to the permeable longitudinal section of the first tubular member, and wherein a plurality of axial partitions are disposed between the first and second tubular members to form a plurality of axial chambers; and using the production system to produce hydrocarbons.

* * * * *